US005412933A

United States Patent [19]

Mallett et al.

[11] Patent Number: 5,412,933

[45] Date of Patent: May 9, 1995

[54] AUTOMATIC LINK FORMING APPARATUS

[75] Inventors: Joel D. Mallett, P.O. Box 216, Jamestown, R.I. 02835; Robert M. Mulligan, 382 Fairview Ave., Coventry, R.I. 02816

[73] Assignee: Joel D. Mallett, Jamestown, R.I.

[21] Appl. No.: 945,905

[22] Filed: Sep. 17, 1992

[51] Int. Cl.[6] ..... B21L 1/02; B21L 13/00

[52] U.S. Cl. ..... 59/23; 59/24; 59/25; 59/27

[58] Field of Search ..... 59/16, 18, 19, 23, 27, 59/24, 25

[56] References Cited

U.S. PATENT DOCUMENTS

| | | | |
|---|---|---|---|
| 1,478,808 | 12/1923 | Webber | 59/18 |
| 1,478,814 | 12/1923 | Bittrolf | 59/18 |
| 2,680,344 | 6/1954 | Capellazzi et al. | 59/27 |
| 2,713,765 | 7/1955 | Capellazzi et al. | 59/27 |
| 3,004,383 | 10/1961 | Crafford | 59/25 |
| 3,354,633 | 11/1967 | Crafford | 59/24 |
| 3,841,088 | 10/1974 | Crafford et al. | 59/25 |
| 4,503,664 | 3/1985 | Allazzetta et al. . | |
| 4,910,954 | 3/1990 | Tizzi | 59/27 |
| 4,982,593 | 1/1991 | Holloway | 72/302 |

FOREIGN PATENT DOCUMENTS

| | | |
|---|---|---|
| 529221 | 7/1920 | France . |
| 1059145 | 6/1952 | France . |
| 166860 | 7/1921 | United Kingdom . |
| 178535 | 4/1922 | United Kingdom . |
| 1136364 | 12/1968 | United Kingdom . |

*Primary Examiner*—David Jones
*Attorney, Agent, or Firm*—John A. Haug

[57] ABSTRACT

A machine is shown for feeding a length of wire to a forming station, cutting and forming the length into a U-shaped element around an arbor, moving the U-shaped element to a presentation position in a channel of a face plate with the free ends of the element extending out of the face plate, then forming the free ends into a closed loop by means of a forming head engaging the ends and bending them into the loop and finally ejecting the element from the face plate.

15 Claims, 13 Drawing Sheets

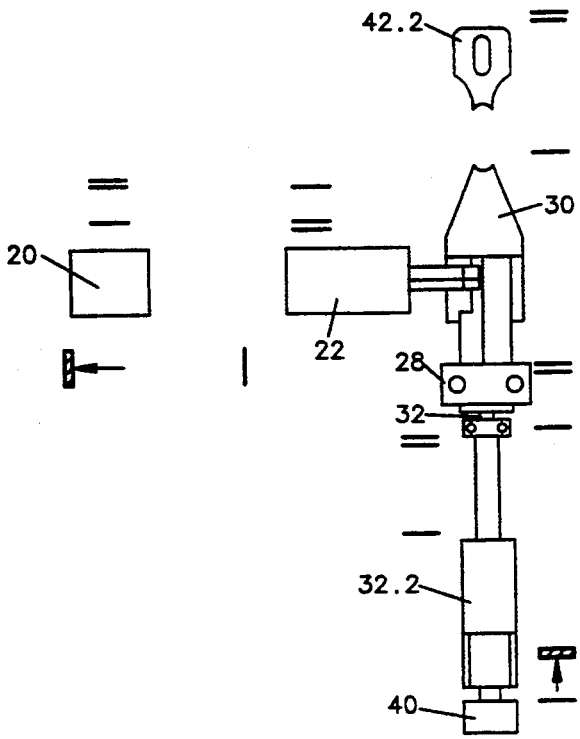
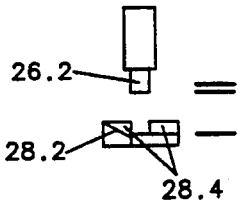
FIG. 11C.
FIG. 11c.
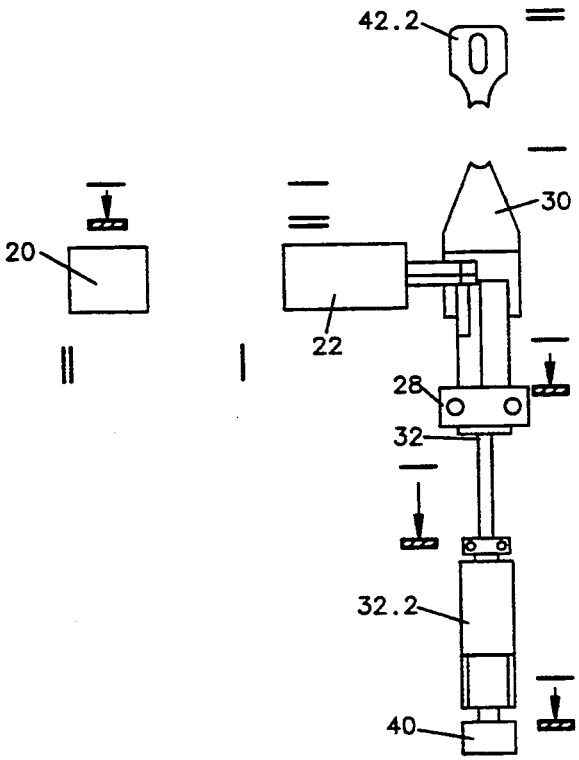
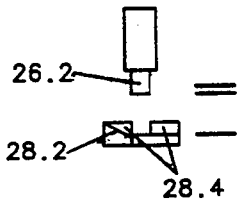
FIG. 11D.
FIG. 11d.

AUTOMATIC LINK FORMING APPARATUS

FIELD OF INVENTION

This invention relates generally to apparatus for forming wire links and more specifically to apparatus which can form such links from a wide range of wire diameters. Such links are useful in the jewelry industry as jump rings for joining various elements together such as chains, charms and the like as well as in various other uses such as fishing lures, key chains, purse stapes to name but a few.

BACKGROUND OF INVENTION

Machines for automatically, forming links are conventional. For example U.S. Pat. Nos. 3,004,383; 3,128,028 and 3,354,633 relate to a chain linking machine wherein wire stock is fed to a severing mechanism which cuts the wire into a plurality of wire sections. The machine forms the severed wire sections into U-shaped configurations, stores the U-shaped sections in a magazine in stacked relation and by means including a pusher blade transfers the U-shaped sections to an assembly station where each section is sequentially formed into a link.

Although such machines have been in wide commercial use there are several problems associated with the machines which limit their effectiveness. One of the main problems is the tendency for the stack of formed U-shaped links to become jammed thereby causing downtime of the machine, frequently involving disassembly of various components to remove the jam. Another limitation relates to the range of wire diameters which the machine can effectively accommodate. As the size of wire is decreased the tendency of jamming is increased. For example, when the wire being processed is reduced to approximately 0.016 inch the frequency of jamming becomes a significant limitation and serves as a limit to the size of the wire which the machine can effectively handle. Yet another limitation in the above machines is the tendency of the wire to be marred by the handling, feeding and stacking manipulations involved in processing of the wire. For example, in U.S. Pat. No. 3,128,028 referred to supra, engagement of gripping bar 40 locking the wire to the feed block 26 as well as the tensioning mechanism 90 having grooves 110 and 113 to apply frictional contact to the wire tend to result in marking or marring of the wire. Once the U-shaped sections are formed they are transferred and fed through a magazine, for example by stripper plate 99, transfer blade 160 and spring 166 as described in U.S. Pat. No. 3,354,633 which tend to further blemish the surface of the wire sections.

One attempt to mitigate the jamming problem of the prior art was to obviate the magazine assembly by placing previously formed U-shaped elements in a bowl feeder which then fed the elements to the forming machine for closure of the link however this still involved the use of guide tracks and escape mechanisms and the like for presenting single elements to the forming machine which also resulted in jamming problems as well as adding significantly to the cost of manufacture due to the requirement of having to premanufacture or purchase the U-shaped elements, handle them, maintain an inventory etc.

SUMMARY OF THE INVENTION

It is therefore an object of the present invention to provide an improved apparatus for automatically forming a closed wire link not having the limitations of the prior art referred to above. Another object of the invention is the provision of apparatus which can process a wide range of wire diameters with little or no propensity for jamming problems. Yet another object is the provision of apparatus which is relatively simple and economical, yet reliable. Still another object of the invention is the provision of apparatus for handling and feeding wire to be processed as in forming a length of wire into a closed link, which does not mar the surface of the wire. Another object is the provision of a link forming machine which can accommodate wires of different profiles, i.e. circular, oval, flat, and so on and form them into a variety of different shaped links such as circular, oval, oblong, square or triangular and which can be easily retooled and changed from one version to another.

The above objects and still further objects of the invention will become apparent to those skilled in the art after consideration of the following preferred embodiments thereof, which is provided by way of example and not by way of limitation.

Briefly, in accordance with the invention, a wire of any of various diameters and shapes depending on the desired finished product is paid out from a suitable supply and is trained through an oiling device and in turn through first and second releasable wire gripping means. According to a feature of one embodiment of the invention the gripping means each comprises a body of resilient material through which a bore extends. The wire is received through the bore and is gripped without marring when a compressive force is placed on the body and is free to pass through the body when the compressive force is removed. In a modified embodiment the material of the gripping means comprises a tube of resilient material through which the wire is directed and which is subjected to a compressive force to grip the wire in the same manner as in the previous embodiment. In yet another modified embodiment the gripping means comprises a pair of plates, at least one of which is formed of resilient material. One of the pair, preferably of more resilient material than the other, is adapted to move into and out of engagement with the other plate to apply the compressive force to the wire as in the above embodiments. The first gripping means is adapted to grip the wire and feed a selected length to a forming area station through the second unactivated gripping means by sliding between first and second positions. When the selected length of wire is presented at the forming station the second gripping means is activated and securely holds the wire and a severing and forming tool is moved to sever the length and form it around an arbor into a U-shaped element. The arbor is then removed from the forming area and a pusher blade engages and moves the U-shaped element through a channel in a face plate up to a second, presentation, position with the free ends of the U-shaped element extending out of the face plate. At this point, which is the neutral position of the cycle, the end or ends of a chain or the like can be placed over one or both of the free ends of the U-shaped element and an operator can initiate a new cycle by actuating a suitable switch. A forming head is then brought down into engagement with the free ends of the U-shaped element, bending the ends into a closed loop or link capturing the chain end(s). According to a feature of the invention, the forming head is provided with a replaceable forming member so that the entire head need not be discarded when replacement is desired or necessary. After the link is closed the pusher blade is caused to move upwardly to a third, ejection, position to eject the formed link from the apparatus. According to another feature of the invention, the pusher blade is mounted on a first pusher blade pneumatic cylinder with its vertical location being adjustable to any selected position with the cylinder moving the pusher blade along a staight line between its first and second position. According to yet another feature of the invention the first pusher blade cylinder is mounted in tandem relation on a second, ejection, pneumatic cylinder which moves the pusher blade, along with the pusher blade cylinder, further along the staight line to the third, ejection, position. The ejection cylinder is also provided with vertical adjustment means. Once the link is ejected the cycle continues on to present another length of wire and form it into a U-shaped link and place it in the second, presentation, position.

BRIEF DESCRIPTION OF THE DRAWINGS

The details of the invention will be described in conjunction with the accompanying drawings in which.

DESCRIPTION OF THE PREFERRED EMBODIMENT

Figure 1:
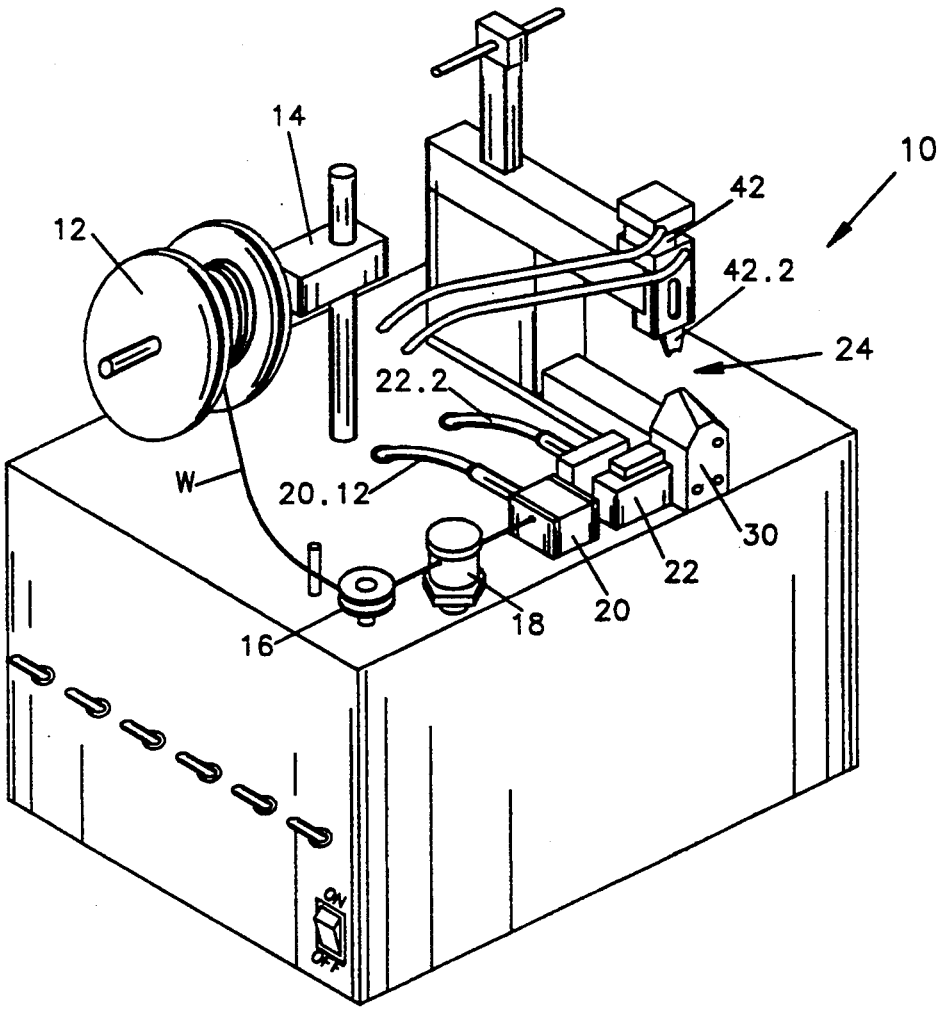
FIG. 1 is a perspective view showing an automatic link forming machine made in accordance with the invention.

Referring now to the drawings wherein like parts are represented by like numerals throughout the figures of the drawings, with particular reference to FIG. 1, link forming apparatus 10 made in accordance with the invention is shown comprising a supply reel 12 of wire of any selected material, such as brass, gold, steel, etc., on a suitable reel support 14. The wire w is directed around an idler pulley 16 through an oiling device 18, a feeder assembly 20, a wire holding assembly 22 to a forming station 24.

Figure 2:
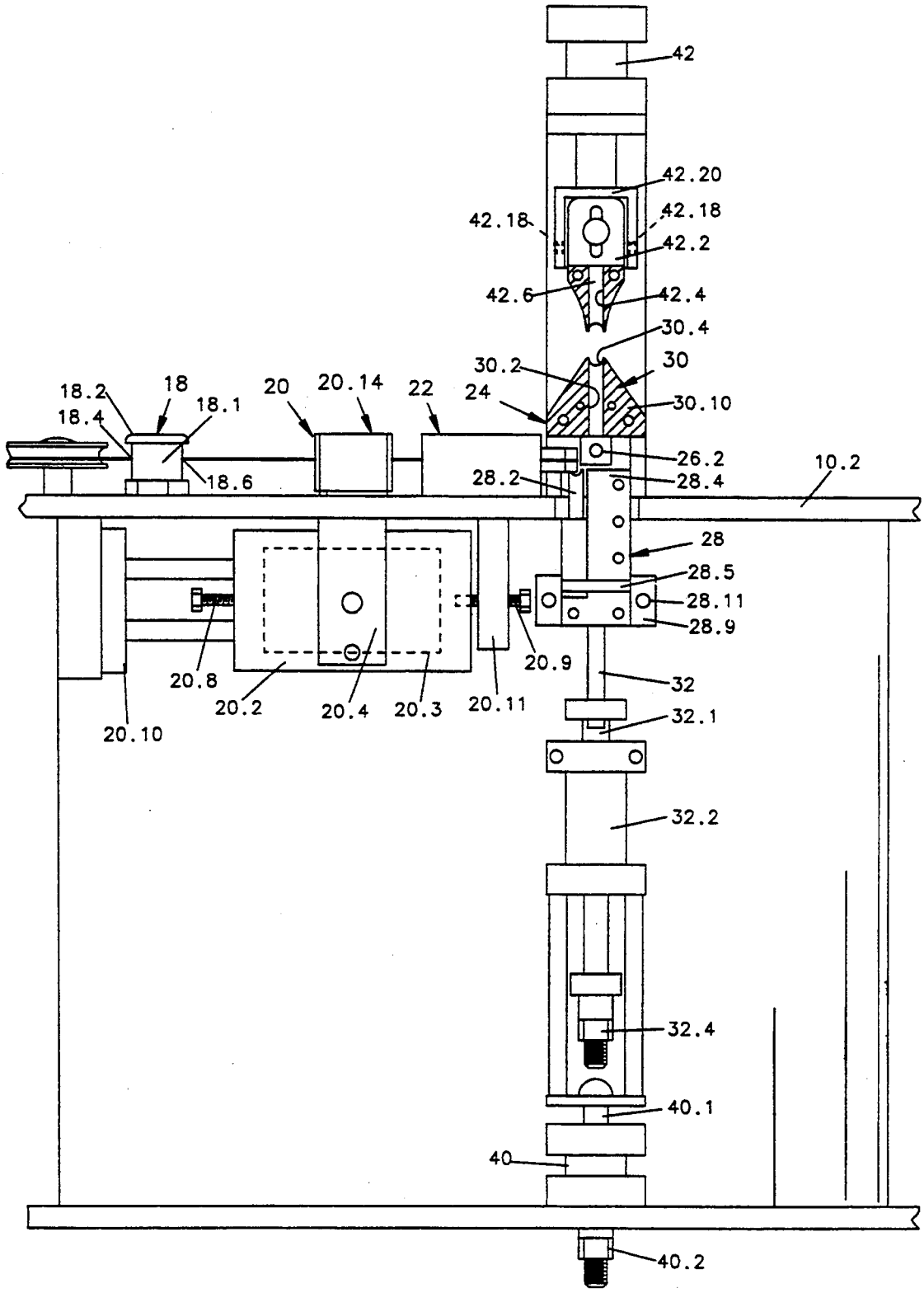
FIG. 2 is a front view of selected components of the FIG. 1 machine shown with the front panel removed and with portions in cross-section.

As seen in FIG. 2, oiling device 18 is generally cup-shaped having an upstanding wall 18.1 and pivotable cap 18.2 with two aligned apertures, 18.4, 18.6 respectively, in wall 18.1 for reception of wire w therethrough. Suitable absorbant material, such as felt (not shown) is placed in device 18 which material is maintained saturated with oil in order to deposit a thin layer on the wire as it passes through the device.

Figure 3:
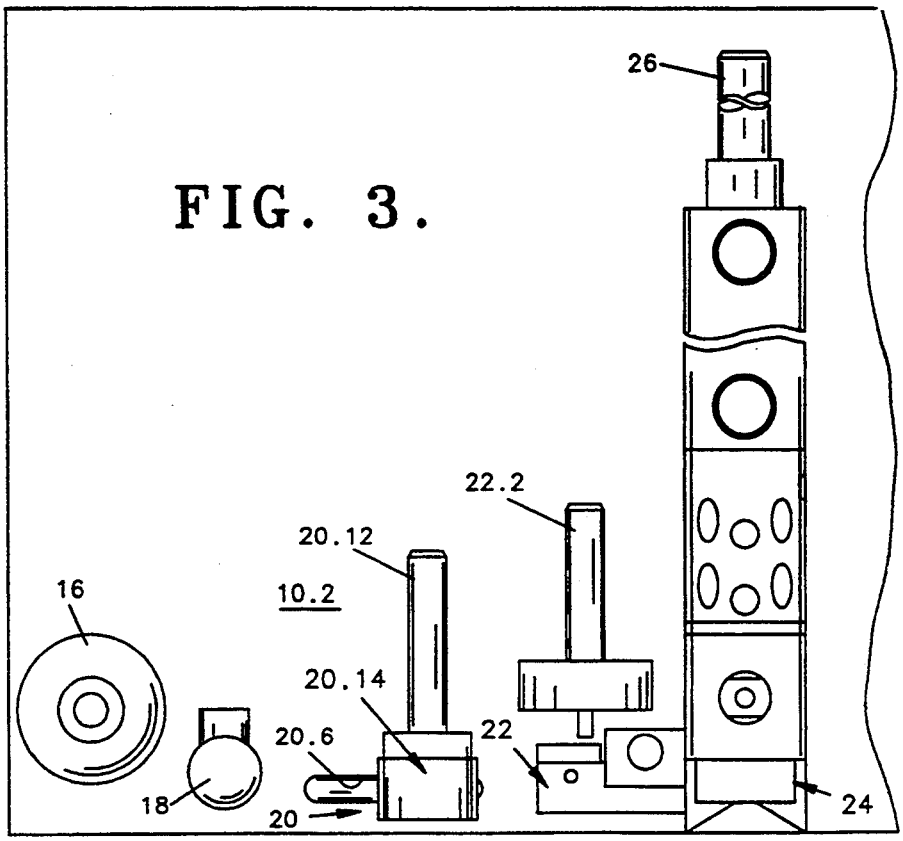
FIG. 3 is a top view showing the components depicted in FIG. 2.
Figure 5:
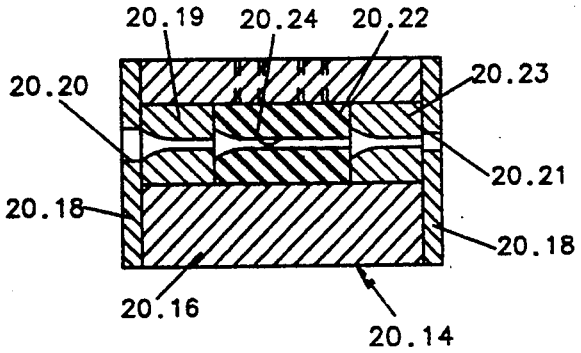
FIG. 5 is a cross sectional view of the feeder block assembly.

Wire feed assembly 20, see FIGS. 2, 3 and 5, comprises a housing containing a pneumatic cylinder 20.2 attached to arm 20.4 which in turn extends through a slot 20.6 (FIG. 3) in top plate wall member 10.2 of apparatus 10. Cylinder 20.2 and arm 20.4 are adapted to move laterally in a linear direction between two extremities upon actuation and deactuation of the cylinder. Preferably an adjustable stop 20.8 extends laterally toward base 20.10 which serves to limit motion of the cylinder in one direction and an adjustable stop 20.9 mounted on stationary leg 20.11 extends laterally toward a back surface 20.3 of the cylinder housing to limit motion in the opposite direction as selected.

A second wire clamp cylinder 20.12 (FIG. 3) is attached to a wire clamp block 20.14 which, when actuated, applies a gripping force to a wire extending through the block as will be explained in greater detail below. When in the unactuated condition the wire is free to pass through block 20.14.

Wire hold cylinder 22.2 (FIG. 3) is also adapted, when actuated, to apply a force on the wire disposed in wire hold block 22. As in the case of the wire feed block, when unactuated the wire is free to pass through the hold block.

Forming station 24 comprise several members which cooperate with one another in forming a link. As seen in FIG. 3, arbor cylinder 26 is adapted to move an arbor 26.2 (FIG. 2) laterally in a direction generally perpendicular to the longitudinal axis of the wire being fed into the forming station between a protracted position in the forming area and a retracted position out of the forming area. The arbor is shaped to the desired link shape, ie, oval, round, etc. As shown, the arbor is a generally cylindrical member having a longitudinal axis which lies parallel to the direction of movement of the arbor.

Figure 4:
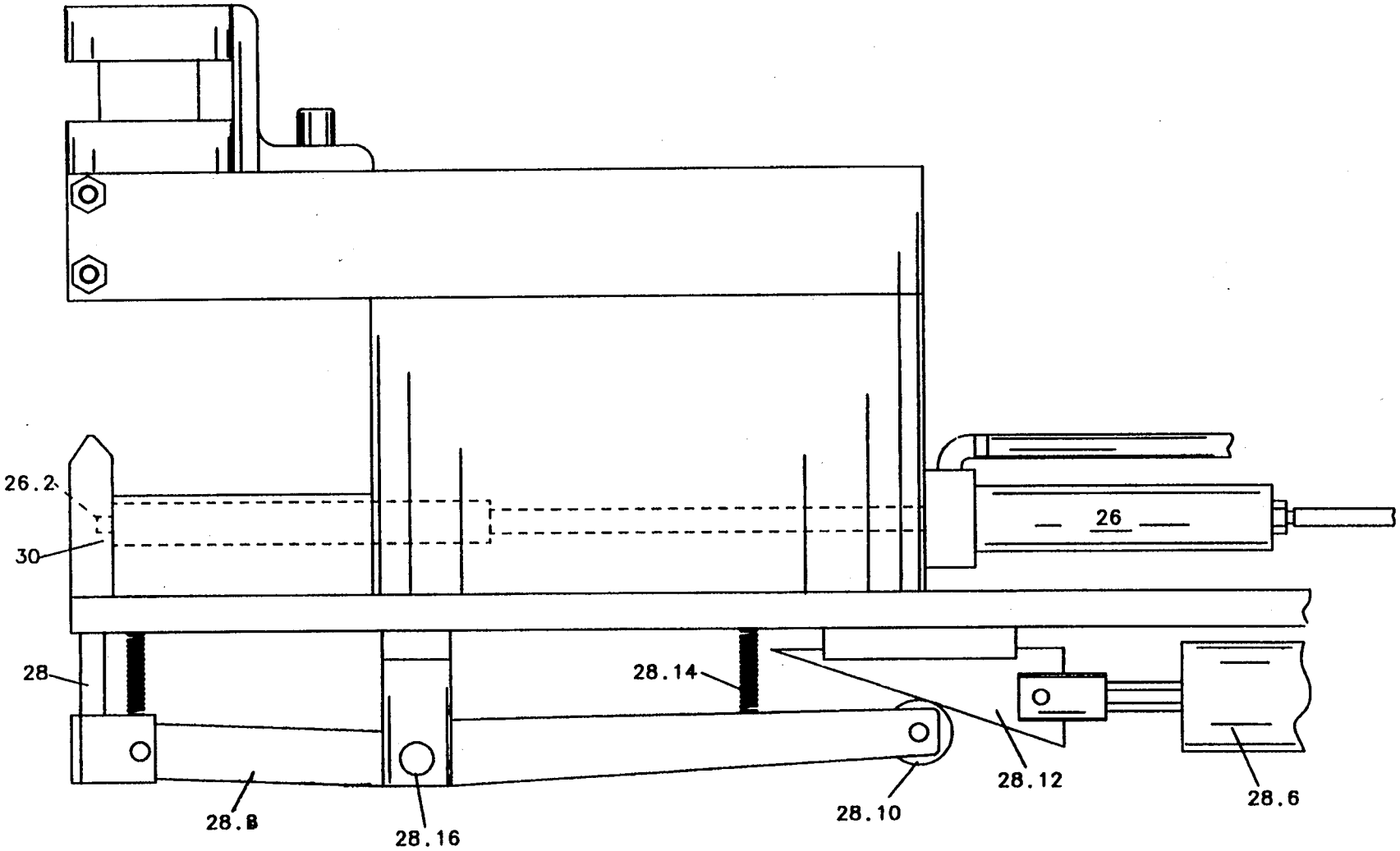
FIG. 4 is a side view showing the mechanism for moving the forming assembly between its operating and non-operating positions as well as showing the arbor cylinder and arbor holder.
Figure 8:
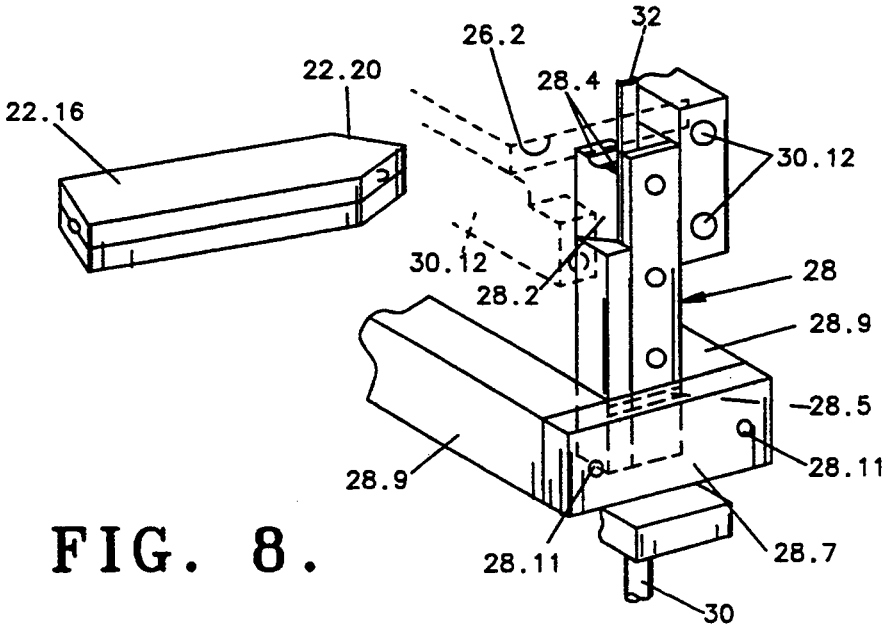
FIG. 8 is a perspective view of a portion of the lower forming assembly.

A forming assembly 28, as best seen in FIGS. 2 and 8, comprises a cutting blade 28.2 and spaced forming elements 28.4 which are locked together by key 28.5 (FIG. 2) disposed behind a retainer bar 28.7 which is attached to supports 28.9 by fasteners, not shown, at 28.11. Cutting blade 28.2 and forming elements 28.4 are vertically movable from a position below the forming area to the forming area position by forming assembly cylinder 28.6 seen in FIG. 4. Forming assembly 28 is hingedly coupled to arm 28.8 at one end thereof whose opposite end mounts a cam follower 28.10 which is urged by spring 28.14 into engagement with movable cam 28.12 connected to cylinder 28.6. Arm 28.8 is pivoted at 28.16 so that outward movement of the cylinder rod attached to cam 28.12 upon actuation of the cylinder in one direction causes assembly 28 to move upwardly. Actuation of the cylinder in the opposite direction brings assembly 28 into the lower position.

Figure 2A:
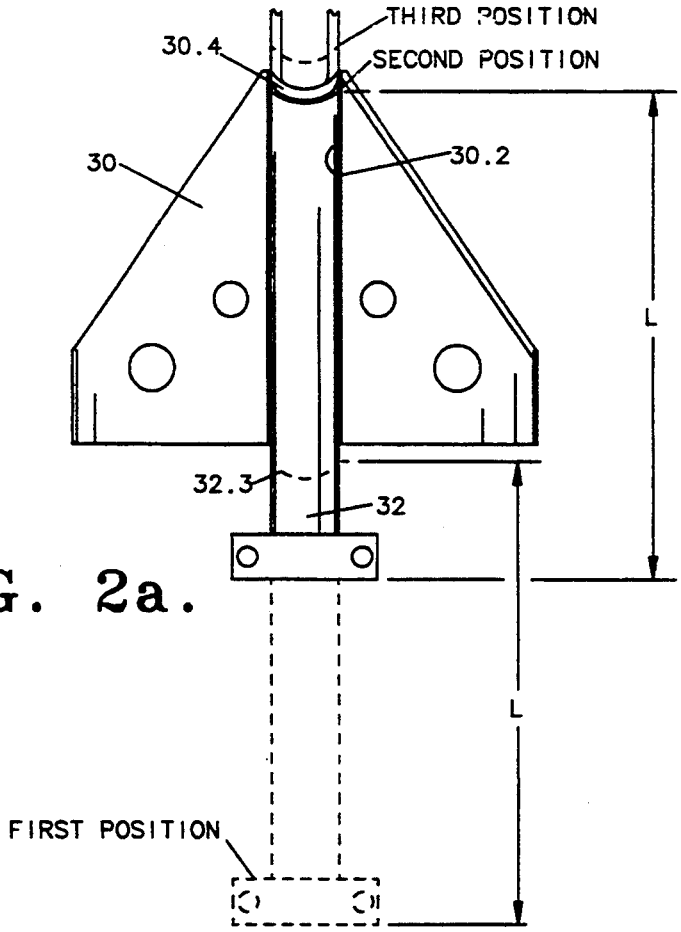
FIG. 2*a* is a schematic representation of a pusher blade in three different operational positions.
Figure 9:
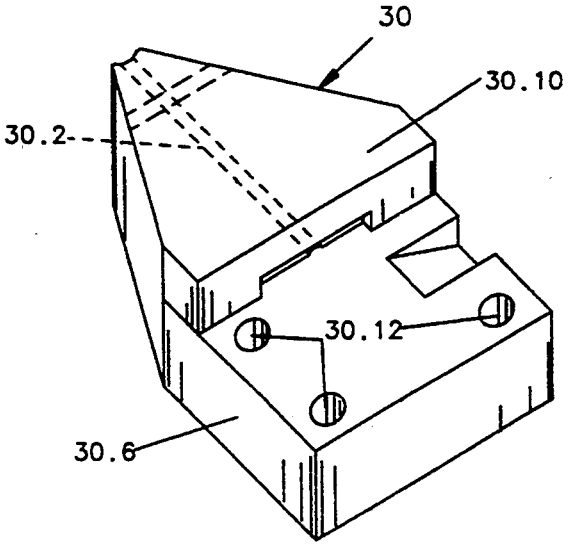
FIG. 9 is a perspective view of a face plate which cooperates with the FIG. 8 forming assembly.
Figure 9A:
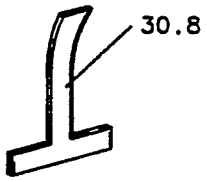
FIG. 9*a* is a perspective view of a spring used in the FIG. 9 face plate.

Forming station 24 also comprises a stationary face plate assembly 30, seen in FIG. 9 and in cross section through plate 30.10 in FIG. 2 for purposes of illustrating channel 30.2 which extends vertically in alignment with the forming area. Channel 30.2 has an upper presentation area 30.4 to be explained below. With particular reference to FIG. 2*a* pusher blade 32 is adapted to move vertically between a first position with its top distal free end 32.3 below the forming area and a second position with the distal free end 32.3 located adjacent the presentation area in channel 30.2 by cylinder rod 32.1 of pusher blade cylinder 32.2. The specific location of the second position can be precisely adjusted by means of threaded adjustment 32.4 (FIG. 2) to change the effective length of the cylinder rod.

Pusher blade cylinder 32.2 is connected in tandem relation through cylinder rod 40.1 to link ejector cylinder 40 which is adapted to move pusher blade 32, along with pusher blade cylinder 32.2, vertically to a third, eject, position above the presentation area of channel 30.2. The specific location of the third position can be separately adjusted by means of threaded adjustment 40.2 to change the effective length of its cylinder rod.

Forming head cylinder 42 is positioned above the forming area and is attached to forming head 42.2 (FIG. 10) which has a removable front plate shown in cross section in FIG. 2 in order to illustrate a vertically disposed channel 42.12 which receives a replaceable forming blade 42.14. Forming head 42.2 is adapted to move vertically from a position above the presentation area as shown in FIG. 2 downwardly to a position closely adjacent the presentation area 30.4 as will be explained below.

Operation of the link forming apparatus will be explained with particular reference to FIGS. 12*a*–12*f* in which various processing steps of the wire are shown and FIGS. 11*a*, 11A to 11*j*, 11J in which the several steps of the cycle of the apparatus are illustrated and in which movement of members are designated by an arrow and three parallel lines, two of which are close to one another showing the at rest position of each member. In each step the members that are changing positions are indicated by cross hatching between the two close lines.

The cycle is initiated with a length of wire already formed into a generally U-shaped configuration and held stationary by face plate spring 30.8, to be discussed below, in channel 30.2 at the presentation position 30.4 with the two free ends of the wire element projecting upwardly out of channel 30.2 as seen in FIG. 2*a*. At this point in the cycle the end rings of a chain, or the ring of a charm, logo or the like can be placed over one or both ends of the link, as desired, for attachment thereto.

Figure 11A:
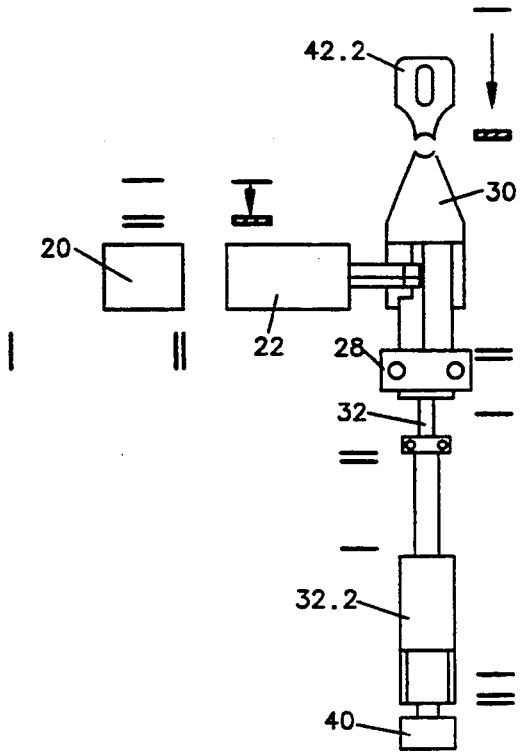
FIGS. 11*a;* A–FIGS. 11*j,* J are schematic representations of cooperating components of the apparatus in each of the steps of a complete cycle of the machine.
Figure 11A:
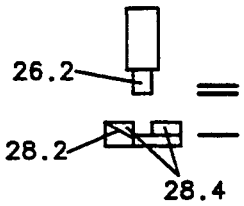
Figure 12A:
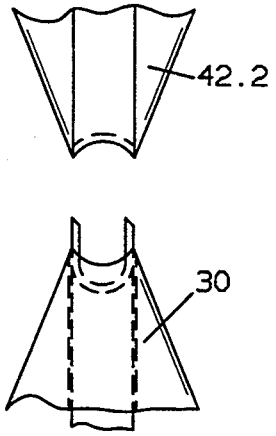
FIGS. 12*a*–12*f* are schematic views showing various processing steps of the wire.
Figure 12B:
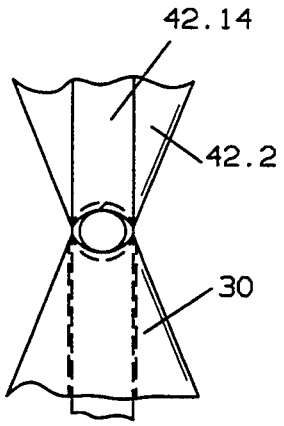

As indicated in FIGS. 11*a* and 12*b* the forming head cylinder 42 is actuated causing head 42.2 to descend with blade 42.14 moving into engagement with the ends of the U-shaped element bending the ends to form a ring or link. At the same time wire hold cylinder 22.2 is actuated to firmly hold wire w. It will be seen that all the other cylinder operated members, including arbor cylinder 26.2 shown in FIG. 11A, are in their at rest positions.

Figure 11B:
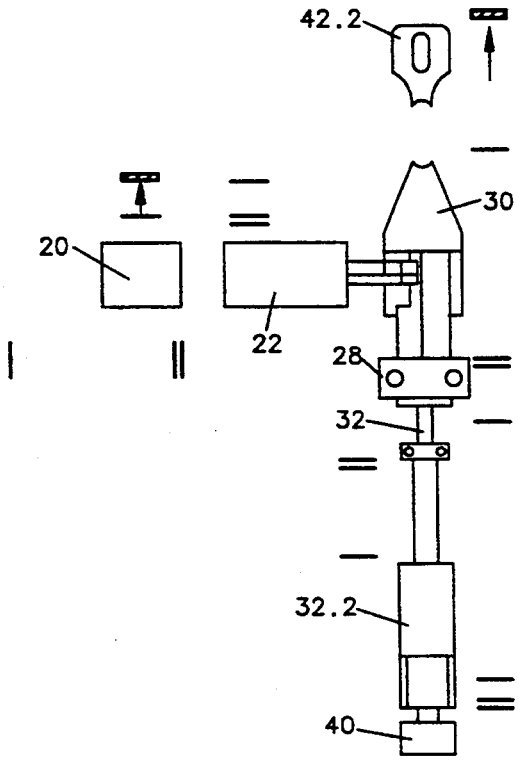
Figure 11B:
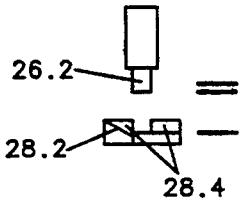

In step 2, FIGS. 11*b*, 11B, head cylinder 42 reverses and head 42.2 moves upwardly away from the forming area. Wire feed cylinder 20.12 is deactuated to release wire w in feed mechanism 20.

At this point in the cycle if the apparatus is provided with a welding system (not shown) and if it is desired to weld the link, the cycle would be interrupted to allow the electrode to move to the forming area in order to effect such welding. After the electrode retracts the welding system provides a signal to the link forming apparatus to resume the cycle. A suitable welding system useful with the link forming apparatus of the present invention is shown and described in U.S. Pat. No. 4,388,513, the subject matter of which is incorporated herein by this reference.

Figure 12C:
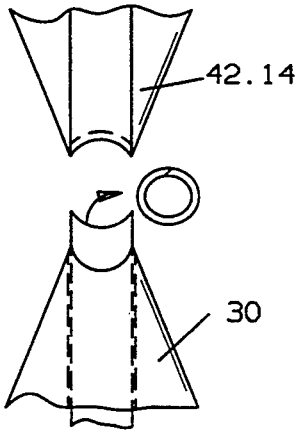

In step 3, FIGS. 11*c*, 11C and 12*c*, link ejector cylinder 40 is actuated moving the pusher blade 32 and pusher blade cylinder 32.2 vertically upward thereby ejecting the formed, and if welded, the welded link from face plate 30. The wire feed cylinder 20.2 is actuated causing the feed block of feed mechanism 20 to slide, as seen in the figure, to the left, ie, in a direction away from the forming area until stop 20.8 engages base 20.10 (FIG. 2).

In step 4, FIGS. 11*d*, 11D, link ejector cylinder 40 reverses and pusher blade cylinder 32.2 is actuated causing its rod to descend, along with pusher blade 32, to their lower or bottom positions. Forming assembly cylinder 28.6 is actuated lowering the forming assembly 28 and cylinder 20.12 is actuated to grasp wire w in feed mechanism 20.

Figure 11E:
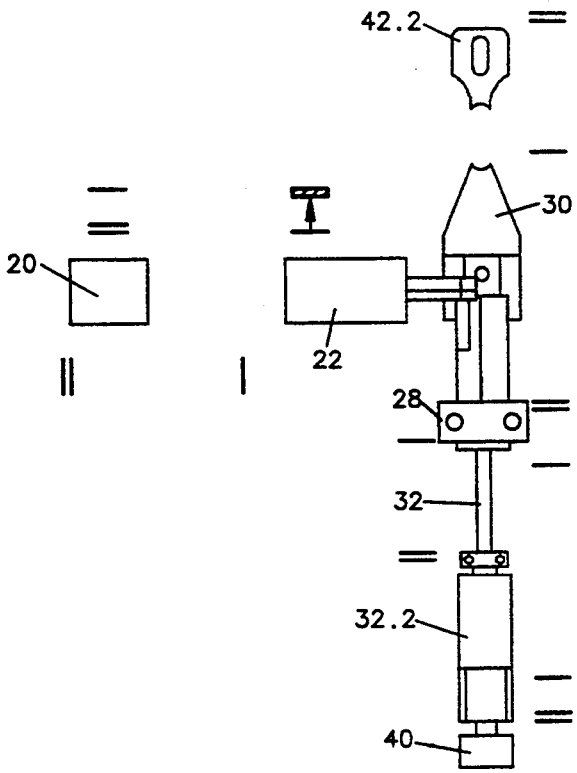
Figure 11E:
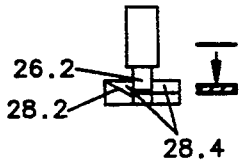

In step 5, the arbor cylinder 26 is actuated causing the arbor to move to the protracted position as indicated in FIG. 11E, and as shown in FIG. 11*e*, the wire hold cylinder 22.2 is deactuated causing the holding mechanism 22 to release the wire.

Figure 11F:
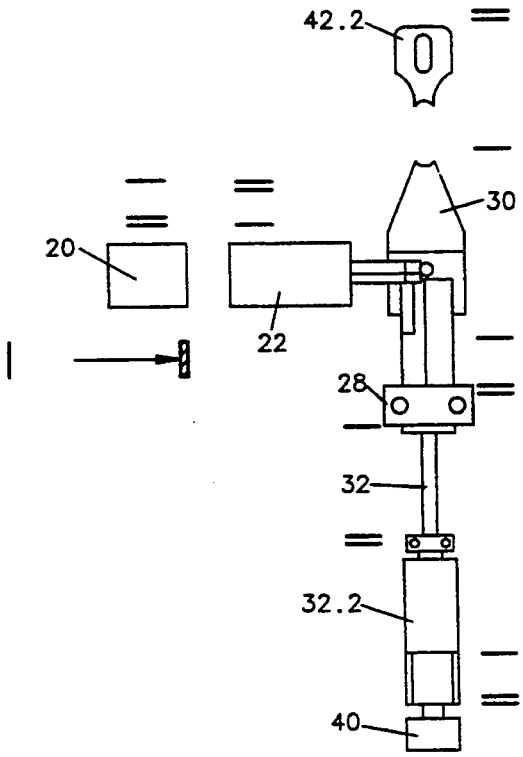
Figure 11F:
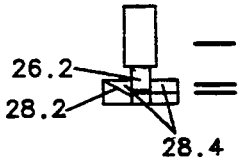
Figure 12D:
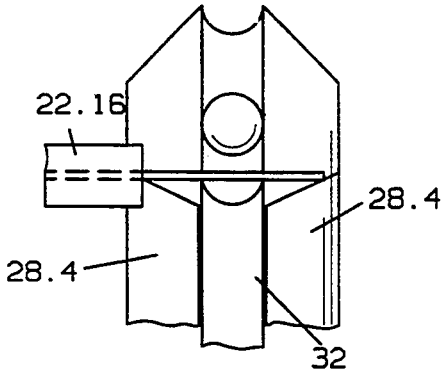

In step 6, FIGS. 11*f*, 11F and 12*d*, the feed slide cylinder 20.2 is activated causing feed block 20 to slide to the right as seen in the figure thereby feeding a length of wire into the forming area beneath the arbor 26.2.

Figure 11G:
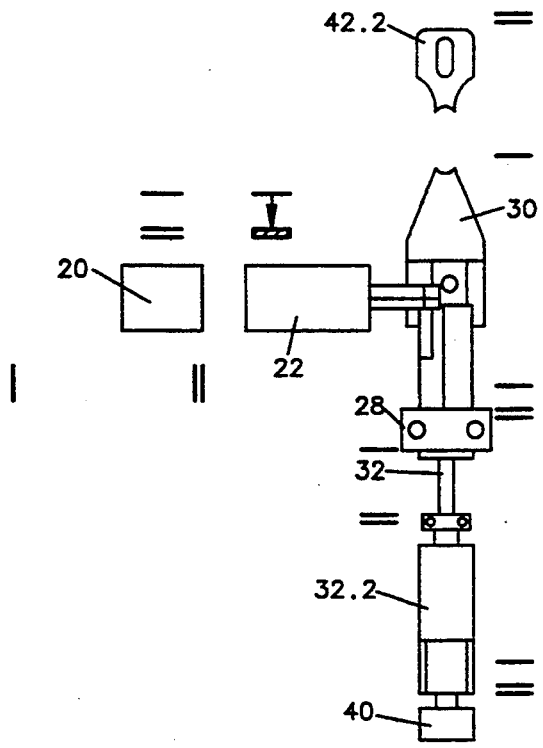
Figure 11G:
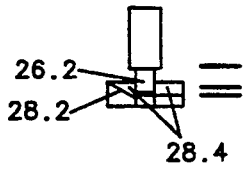

Step 7, FIGS. 11*g*, 11G, show the wire hold cylinder 22.2 being actuated to securely grasp wire w.

Figure 11H:
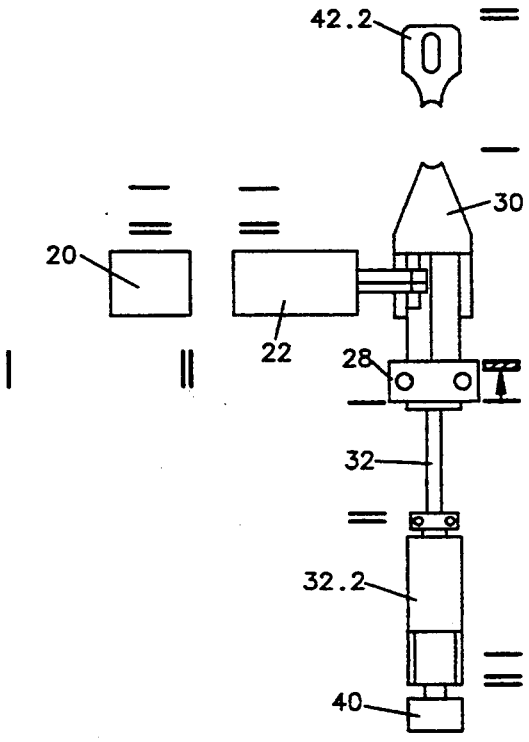
Figure 11H:
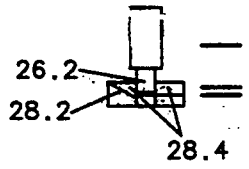
Figure 12E:
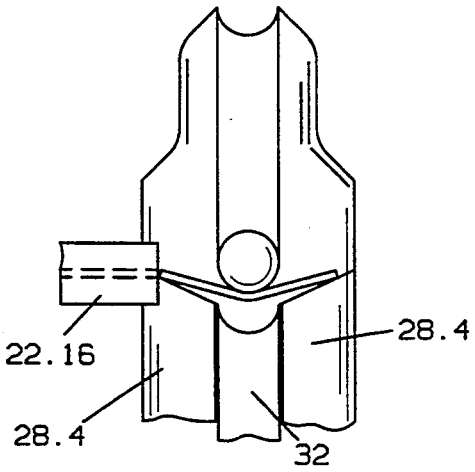
Figure 12F:
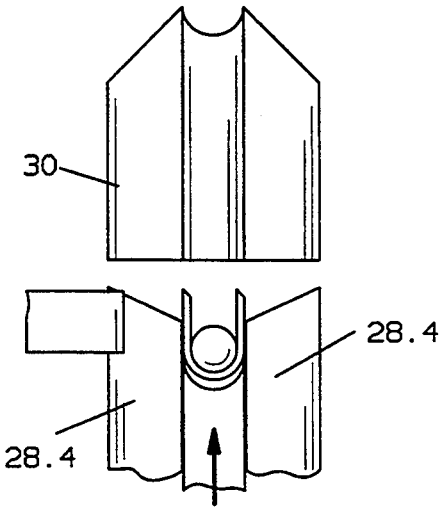

In step 8, FIGS. 11*h*, 11H, the forming assembly cylinder 28.6 is actuated causing the forming assembly to move vertically upward with cutting blade 28.2 severing a length of the wire and forming elements 28.4 bending opposite ends of the wire around arbor 26.2, the initial part of the bending operation being shown in FIG. 12*e* and the completion in FIG. 12*f*, thereby forming the U-shaped configuration of the wire element.

Figure 11I:
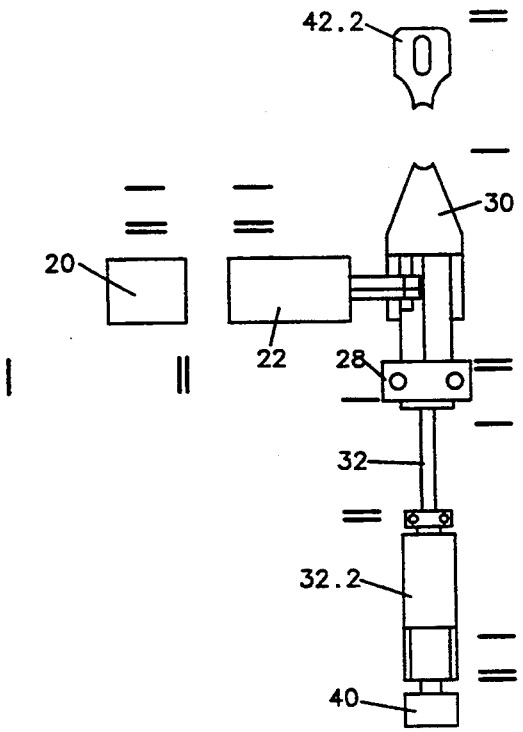
Figure 11I:
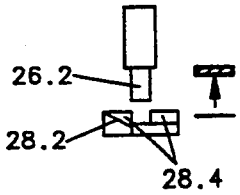

In step 9, FIGS. 11*i*, 11I, arbor cylinder is actuated moving the arbor to the retracted position.

Figure 11J:
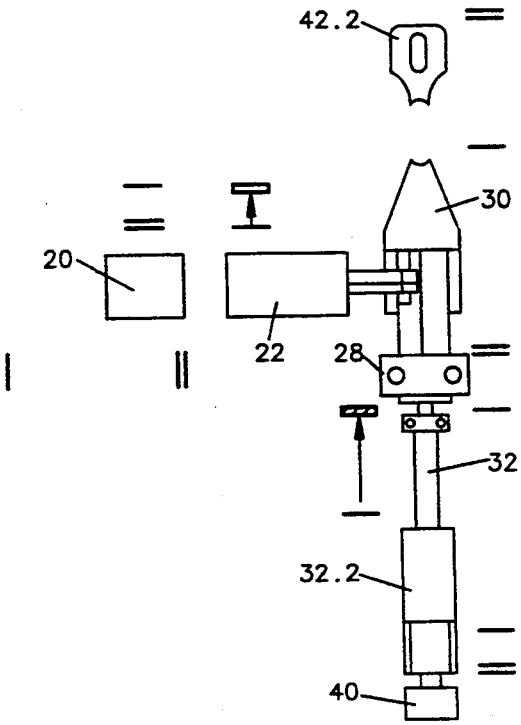
Figure 11J:
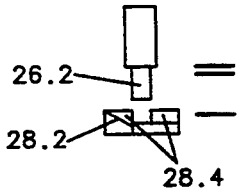

FIGS. 11*j*. 11J represent the neutral position for the machine with the wire hold cylinder 22.2 deactuated to release the wire and pusher blade cylinder 32.2 actuated to move the pusher blade to its second, upper, position adjacent the presentation portion of channel 30.4 moving the U-shaped element to the presentation position with its free ends projecting out of the channel. The apparatus remains in this position until the cycle initiation switch, (eg, foot pedal not shown) is actuated to start a new cycle.

With regard to more specific details of certain of the members referenced above, FIG. 5 shows the wire feed block 20.14 which comprises a hollow housing 20.16 having opposite end retainer walls 20.18 with aligned wire receiving apertures 20.20, 20.21 respectively, formed through the end retainer walls. A body of flexible material 20.22 having a bore 20.24 extending therethrough with an enlarged tapered ingress is disposed within housing 20.16 with bore 20.24 aligned with aperture 20.20. Body 20.22 is sandwiched between guide blocks 20.19 and 20.23 having suitable aligned bores therethrough with similar enlarged ingresses. The cylinder rod of wire feed cylinder 20.12 is adapted to move toward the interior of housing 20.16 upon actuation of the cylinder to apply a compressive force to flexible material 20.22 causing the wall of bore 20.24 to collapse and thereby placing a firm holding force on the wire without marring the surface of the wire. The material of flexible body 20.22 is selected so that it returns to its original configuration essentially instantaneously with little or no hysteresis when cylinder 20.12 is deactuated. Polyurethane has been found to be particularly effective for body 20.22.

Figure 6:
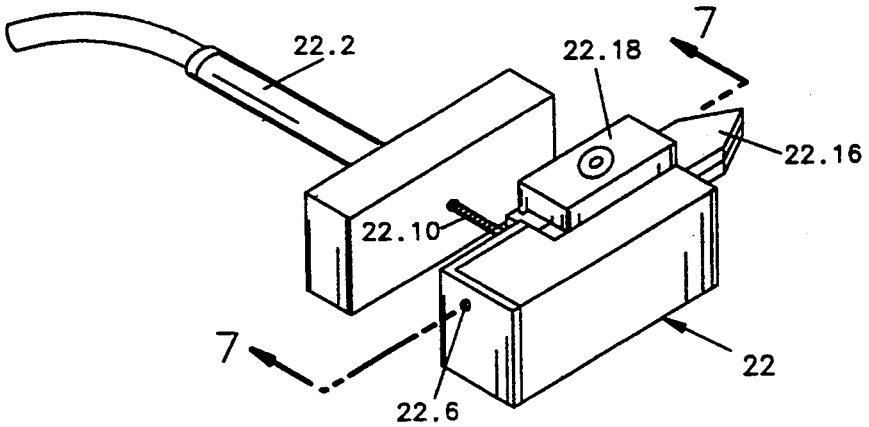
FIG. 6 is a perspective view of the holding block assembly.
Figure 7:
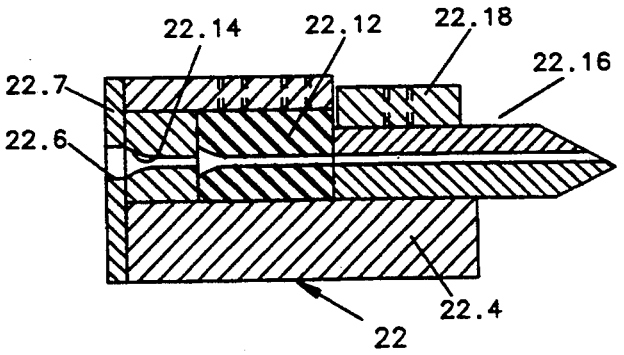
FIG. 7 is a cross sectional view taken on line 7—7 of FIG. 6.

With reference to FIGS. 6 and 7, wire hold block 22 is similarly made up of a hollow housing 22.4 provided with aperture 22.6 in end wall 22.7 and piston rod 22.10 of cylinder 22.2 and is adapted to place a compressive force on a flexible body 22.12 of material preferably the same as body 20.22 disposed within housing 22.4 upon actuation of cylinder 22.2. Such compressive force will collapse the wall of bore 22.14 and firmly grasp the wire w without any danger of marring the wire.

Figure 7A:
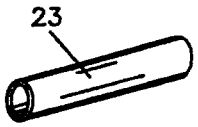
FIG. 7*a* is a perspective view of a modified gripping element useful in the FIGS. 5 and 6 assemblies.
Figure 7B:
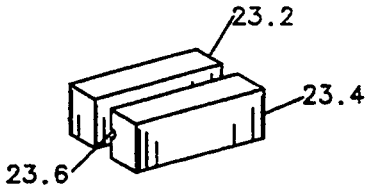
FIG. 7*b* is a perspective view of another modified gripping means useful in the FIGS. 5 and 6 assemblies.

Alternate gripping means are shown in FIGS. 7*a* and 7*b* which can be used with the feed and hold blocks of FIGS. 5 and 7. As seen in FIG. 7*a*, a tube 23 of polyurethane or other resilient material which has the same resilient property as the material of flexible bodies 20.22 and 22.12 or a pair of plates 23.2, 23.4, as seen in FIG. 7*b*, can be placed in housings 20.16, 22.4 to serve as gripping means. With respect to FIG. 7*b* plate 23.2 would be operatively coupled to the cylinder rod 22.10 to move therewith toward and away from stationary plate 23.4. Movable plate 23.2 is preferably formed of the same resilient material as that of flexible bodies 20.22, 22.12. Stationary plate 23.4 may also be formed of resilient material but preferably is less resilient than that of movable plate 23.2 and can even be formed of non-resilient material such as a conventional metal. If desired, a wire guide groove 23.6 can be formed in stationary plate 23.4.

Holding block 22 also mounts cut-off member and wire guide 22.16 (see also FIG. 8 which shows the member in connection with but spaced from its normal position contiguous with blade surface 28.2) by means of rockable clamp member 22.18. Cut-off member and wire guide 22.16 cooperate with blade 28.2 which slides across surface 22.20 (FIG. 8) to shear the length of wire previously fed into the forming area.

Figure 10:
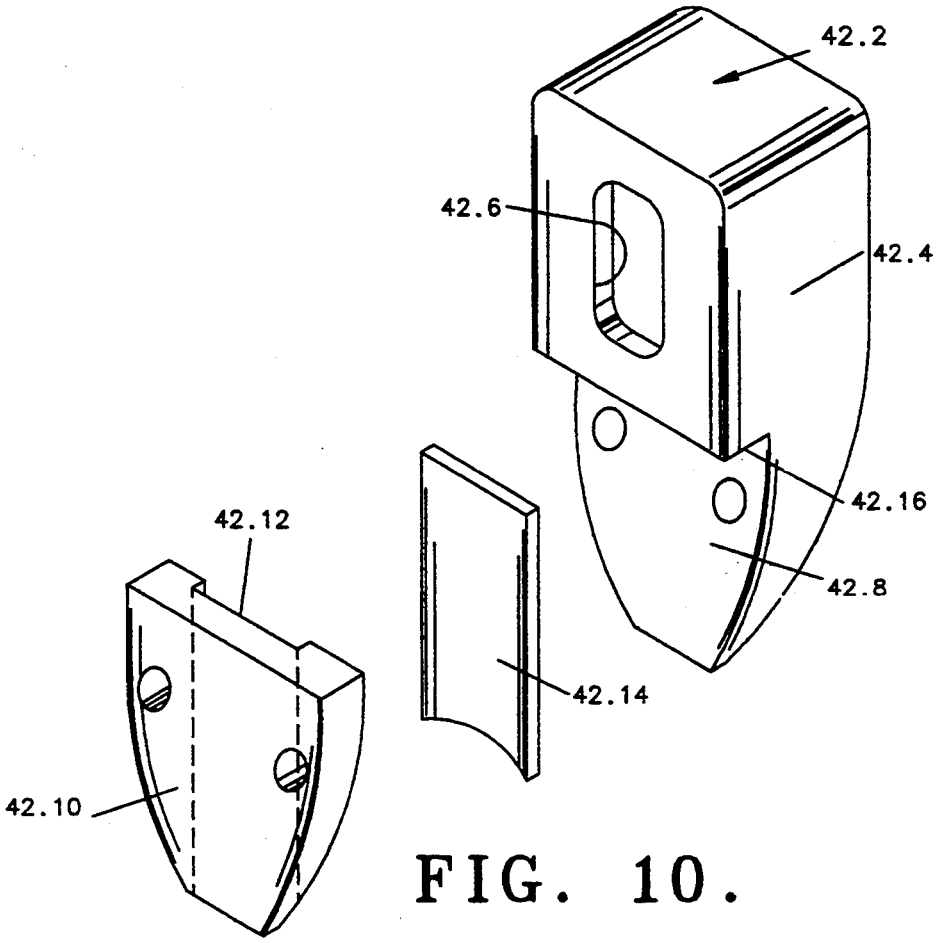
FIG. 10 is a blown apart perspective view of the forming head.
Figure 10A:
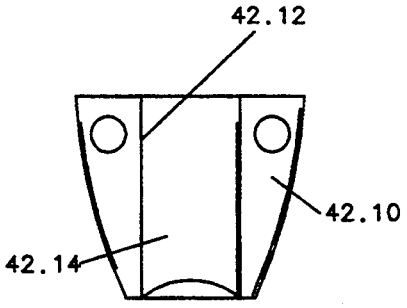
FIG. 10*a* is a rear view of the front plate of the forming head of FIG. 10.

Forming head 42.2 shown in FIG. 10 comprises a base 42.4 having a vertically extending mounting aperture 42.6 to provide a vertically adjustable mount for head 42.2 as best seen in FIG. 2. Base 42.2 is recessed at 42.8 and is adapted to receive in the recess a front plate 42.10. As seen in FIG. 10*a*, a vertically extending channel 42.12 is formed in front plate 42.10 and is adapted to receive a removable forming blade 42.14 having a thickness slightly greater than the depth of channel 42.12. Front plate 42.10 is attached to base 42.4 with suitable fasteners to tightly maintain blade 42.14 in its seat in channel 42.12. The recess 42.8 in base 42.4 forms a reaction ledge 42.16 against which blade 42.14 reacts when the forming head is brought into engagement with the U-shaped elements to form them into the closed loop configuration. As noted in FIG. 10*a*, the blade can be recessed a selected short distance from the lower end of channel 42.12, if desired, to provide a guide surface for the distal free ends of the U-shaped element just prior to engagement of blade 42.14 with the element. Precise vertical adjustment of forming head 42.2 can be provided by a threaded adjustment at the top of forming head cylinder 42. Precise lateral adjustment of the lower end of channel 42.12 can be provided with threaded adjustment screws (not shown) received in threaded bores 42.18 in U-shaped support 42.20. When the blade becomes worn the front plate can easily be removed and the blade replaced with a fresh one. Further, if a different link configuration is desired, such as an oval link rather than a circular one, a blade with its distal end appropriately configured, can be placed in head 42.2 rather than having to rely on an entirely new head. When changing the configuration of the link a suitably shaped arbor and pusher blade would also be installed.

FIG. 9 shows face plate assembly 30 comprising face plate body 30.6 which cooperates with a plate 30.10 in which vertically extending pushing blade channel 30.2 is formed adapted to slidingly receive pusher blade 32. The top portion of the channel 30.4 (FIG. 2) serves as the presentation position. Spring 30.8 is received in a recess indicated by dashed lines in body 30.6 with plate 30.10 received over spring 30.8 and attached to body 30.6 by suitable fasteners, not shown, at 30.12. Spring 30.8 places a force on the formed U-shaped element against the face plate to ensure consistent grounding for the welding operation if it is employed as well as to maintain the vertical orientation of the elements.

The electrical control and pneumatic circuit for controlling the operation of the cylinders described above are adapted from conventional controls and circuits such as that shown in U.S. Pat. No. 4,388,513, referenced above, and therefore a specific description will not be provided here. Further, as mentioned above, although the above description is related specifically to link forming, a welding system can be added, as described for example in U.S. Pat. No. 4,388,513, if it is desired to weld each individual link into a continuous ring.

Although the invention has been described with regard to a specific preferred embodiment thereof, many variations and modifications will become apparent to those skilled in the art. It is therefore the intention that the appended claims be interpreted as broadly as possible in view of the prior art to include all such variations and modifications.

We claim:

1. Link forming apparatus comprising:

a forming station defining a forming area, means to grasp a wire and feed a length into the forming area, an arbor having a longitudinal axis movable horizontally along its longitudinal axis between a retracted position out of the forming area and a protracted position in the forming area with the longitudinal axis of the arbor generally perpendicular to the direction of the wire feed, forming and cutting means vertically movable between a first lower position below the forming area and a second upper position in the forming area wherein a length of wire is severed and formed into a generally U-shaped configuration around the arbor, a face plate mounted in vertical alignment with and above the forming area, the face plate having a channel extending vertically therethrough, pusher blade means for moving a U-shaped length of wire through the channel along a straight line from the location where the U-shaped length was formed around the arbor, the pusher blade means mounted in vertical alignment with the forming area, the pusher blade means having a distal end vertically movable through the forming area so that the distal end of the pusher blade means is among a first lower position below the forming area, a second presentation position in the channel of the face plate with the distal ends of the U-shaped length extending above the face plate, and a third ejection position above the face plate, the pusher blade means including a pusher blade and a first cylinder for moving the pusher blade between the first and second pusher blade positions and a second cylinder connected in tandem with the first cylinder for moving the pusher blade between the second and third pusher blade positions, and a forming head in alignment with and vertically movable between an upper position above the forming area and a second lower position complimentary to the presentation position, the length of wire being positioned below the arbor with the arbor in the protracted position and with the forming and cutting means severing the length and forming the length into a generally U-shaped configuration, the pusher blade, with the arbor in the retracted position, moving the U-shaped length through the forming area and into the face plate channel to the presentation position with the free ends of the length projecting above the face plate, the forming head then descending downwardly into engagement with the free ends of the U-shaped length bending the free ends into a ring configuration and after the forming head ascends back to the upper position the pusher blade moving to its third position to eject the ring configured length of wire.

2. Link forming apparatus according to claim 1 in which the pusher blade moves among the first, second and third pusher blade positions in a straight line.

3. Link forming apparatus according to claim 1 including means to adjust the second vertical position of the pusher blade.

4. Wire link forming apparatus according to claim 3 including means to adjust the third vertical position of the pusher blade.

5. Link forming apparatus according to claim 1 in which the forming head is formed with a channel extending vertically to a bottom surface of the forming head, a removable forming blade member is received in the channel, the forming blade having a distal end with a selected configuration adapted to engage the free ends of the U-shaped length and bend the free ends in conformity with the selected configuration, and means received over the channel to retain the forming blade in the channel.

6. Wire handling apparatus according to claim 1 in which the means to grasp a wire and feed a length include first and second bodies of resilient material having channels extending therethrough for reception of a wire therein and means to place a compressive force selectively to the first and second bodies and to move one of the bodies relative to the other body.

7. Link forming apparatus comprising a face plate having a channel extending vertically therethrough between an ingress and an egress, means to move a generally U-shaped element through the channel including a pusher blade movable vertically from a first relatively low position to a second presentation position within the channel with the top of the blade in the channel adjacent the egress to a third eject position with the top of the blade outside the egress of the channel, the pusher blade being mounted on a first pneumatic cylinder adapted to move the pusher blade between the first and second positions and the first pneumatic cylinder mounted in tandem relation on a second pneumatic cylinder adapted to move the pusher blade between the second and third positions and means to form the free ends of a U-shaped element extending out of the channel when the pusher blade is in the presentation position into a closed loop.

8. Link forming apparatus according to claim 7 including a cylinder rod attached to the first pneumatic cylinder and including means to adjust the vertical second presentation position of the pusher blade by changing the effective length of the cylinder rod of the first pneumatic cylinder.

9. Link forming apparatus according to claim 7 including means to adjust the vertical position of the pusher blade of the second pneumatic cylinder.

10. Link forming apparatus according to claim 7 in which the means forming the free ends of a U-shaped element into a closed loop includes a forming head having a bottom surface and having a channel formed in the head extending to the bottom surface and a removable forming blade is received in the channel, the forming blade having a distal end formed into a selected configuration adapted to engage the free ends to bend the free ends in conformity with the selected configuration.

11. Link forming apparatus comprising a face plate having a channel extending vertically therethrough between an ingress and an egress, means to move a generally U-shaped element through the channel including a pusher blade movable vertically from a first relatively low position to a second presentation position within the channel with the top of the blade in the channel adjacent the egress to a third eject position with the top of the blade outside the egress of the channel, the pusher blade being mounted on a first pneumatic cylinder adapted to move the pusher blade between the first and second positions and the first pneumatic cylinder mounted in tandem relation on a second pneumatic cylinder adapted to move the pusher blade between the second and third positions and means to form the free ends of a U-shaped element extending out of the channel when the pusher blade is in the presentation position into a closed loop, and further including means to cut and form a straight length of wire into the U-shape and means to feed wire to the means to cut and form a straight length into the U-shape including a body of resilient material having a bore extending therethrough, the wire received through the bore and means to selectively place a compressive force on the body to grasp the wire without marring the surface thereof.

12. Link forming apparatus according to claim 11 in which the body of resilient material is formed of polyurethane.

13. Link forming apparatus comprising a face plate having a channel extending vertically therethrough between an ingress and an egress, means to move a generally U-shaped element through the channel including a pusher blade movable vertically from a first relatively low position to a second presentation position within the channel with the top of the blade in the channel adjacent the egress to a third eject position with the top of the blade outside the egress of the channel, the pusher blade being mounted on a first pneumatic cylinder adapted to move the pusher blade between the first and second positions and the first pneumatic cylinder mounted in tandem relation on a second pneumatic cylinder adapted to move the pusher blade between the second and third positions and means to form the free ends of a U-shaped element extending out of the channel when the pusher blade is in the presentation position into a closed loop, and further including means to cut and form a straight length of wire into the U-shape and means to feed wire to the means to cut and form a straight length into the U-shape including first and second plates, the first plate formed of resilient material and being movable toward and away from the second plate, means to guide the wire between the first and second plates and means to selectively move the first plate toward the second plate to place a compressive force on the wire without marring the surface thereof, both the first and the second plates being formed of resilient material with the material of the first plate being more resilient than the material of the second plate.

14. Link forming apparatus according to claim 13 in which a groove is formed in the second plate to serve as a wire guide.

15. Link forming apparatus according to claim 13 in which the first plate is formed of polyurethane.

* * * * *